US010247209B2

(12) United States Patent
Mesturini et al.

(10) Patent No.: US 10,247,209 B2
(45) Date of Patent: Apr. 2, 2019

(54) CONTROL DEVICE FOR ZERO-LEAK DIRECTIONAL CONTROL VALVES

(71) Applicant: WALVOIL S.P.A., Reggio Emilia (RE) (IT)

(72) Inventors: Davide Mesturini, Reggio Emilia (IT); Massimiliano Musiani, Reggio Emilia (IT)

(73) Assignee: WALVOIL S.P.A., Reggio Emilia (RE) (IT)

( * ) Notice: Subject to any disclaimer, the term of this patent is extended or adjusted under 35 U.S.C. 154(b) by 115 days.

(21) Appl. No.: 15/326,299

(22) PCT Filed: Jul. 15, 2015

(86) PCT No.: PCT/IB2015/055358
§ 371 (c)(1),
(2) Date: Jan. 13, 2017

(87) PCT Pub. No.: WO2016/009369
PCT Pub. Date: Jan. 21, 2016

(65) Prior Publication Data

US 2017/0204883 A1 Jul. 20, 2017

(30) Foreign Application Priority Data

Jul. 15, 2014 (IT) ..... BO2014A0407

(51) Int. Cl.
*F15B 11/16* (2006.01)
*F15B 11/00* (2006.01)
(Continued)

(52) U.S. Cl.
CPC ..... *F15B 11/16* (2013.01); *E02F 3/325* (2013.01); *E02F 9/2267* (2013.01);
(Continued)

(58) Field of Classification Search
CPC ..... F15B 11/16; F15B 11/003; F15B 13/01; E02F 9/2271
(Continued)

(56) References Cited

U.S. PATENT DOCUMENTS 4,286,502 A 9/1981 Bianchetta et al.
4,766,728 A 8/1988 Glomeau
2012/0260642 A1* 10/2012 Opdenbosch ..... F15B 7/006 60/327

FOREIGN PATENT DOCUMENTS

EP 2 189 666 A1 5/2010
WO 2011/154810 A1 12/2011

OTHER PUBLICATIONS

International Search Report, dated Jan. 18, 2016, from corresponding PCT application.

* cited by examiner

*Primary Examiner* — Thomas E Lazo
*Assistant Examiner* — Daniel S Collins
(74) *Attorney, Agent, or Firm* — Young & Thompson

(57) ABSTRACT

Hydraulic system, distributor and bidirectional valve to activate the hydraulic actuators (3; 3*a*, 3*b*) of an operating machine; the hydraulic system (1) having: a first high-pressure oil delivery (4); an oil drain (8); a slide valve with a spool, which is axially sliding and is suited to control a hydraulic actuator (3); a second low-pressure oil delivery (6); an activation valve (15); and a bidirectional valve (21) with a first passage opening (22) that can be hydraulically connected, by the slide valve (9) to the first delivery (4) and a second passage opening (23) hydraulically connected to the actuator (3); wherein, the bidirectional valve has an inlet opening (24) that can be connected, by the activation valve
(Continued)

(15) to the second delivery (6) and an outlet opening (25) that can be connected, by the spool (12) to the drain (8).

20 Claims, 5 Drawing Sheets

(51) Int. Cl.
*F15B 13/01* (2006.01)
*E02F 3/32* (2006.01)
*E02F 9/22* (2006.01)

(52) U.S. Cl.
CPC ..... *E02F 9/2271* (2013.01); *F15B 11/003* (2013.01); *F15B 13/01* (2013.01); *F15B 2211/30515* (2013.01); *F15B 2211/329* (2013.01); *F15B 2211/355* (2013.01); *F15B 2211/6355* (2013.01)

(58) Field of Classification Search
USPC ..... 91/461
See application file for complete search history.

CONTROL DEVICE FOR ZERO-LEAK DIRECTIONAL CONTROL VALVES

TECHNICAL FIELD

The present invention relates to a hydraulic system, to a distributor and to a bidirectional valve for actuating operating machines. In particular, the present invention relates to a control device for zero-leak directional control valves.

The present invention provides for advantageous application to a hydraulic system for actuating a mini-excavator, to which the following description will make explicit reference without loss of generality.

PRIOR ART

It is known, for example from WO2011154810, that a hydraulic system for actuating a mini-excavator comprises a distributor suited to control a plurality of hydraulic actuators operated by means of slide valves. For example, generally, a mini-excavator comprises a double acting hydraulic cylinder to perform lifting operations and a double acting hydraulic cylinder for swivel operations. It is possible that during the operational steps, or when the machine is on standby, the hydraulic cylinder for lifting and/or swivelling is loaded by external loads.

For obvious safety reasons, is known the use of locking systems of the control spool by means of mechanical or hydraulic systems or by means of the insertion of additional spools interposed between the main valve and the actuators so as to prevent a backflow of oil towards the slide valves themselves with a consequent unintentional activation of the actuators.

However, these known solutions of mechanical or hydraulic type do not prevent the oil leakage, which in time may cause undesired actuation of the slide valves and the consequent displacement of the actuators. In other words, the known type solutions are not zero-leak.

DESCRIPTION OF THE INVENTION

The object of the present invention is to provide a hydraulic system comprising control sliders for the individual actuators and bidirectional (zero-leak) valves where necessary, allowing to eliminating the drawbacks described above and at the same time being easy and inexpensive to produce.

According to the present invention, a hydraulic system, a distributor and a bidirectional valve as defined in the appended claims are provided.

BRIEF DESCRIPTION OF THE DRAWINGS

The invention will now be described with reference to the accompanying drawings, which illustrate a non-limiting embodiment, wherein.

PREFERRED EMBODIMENTS OF THE INVENTION

Figure 1:
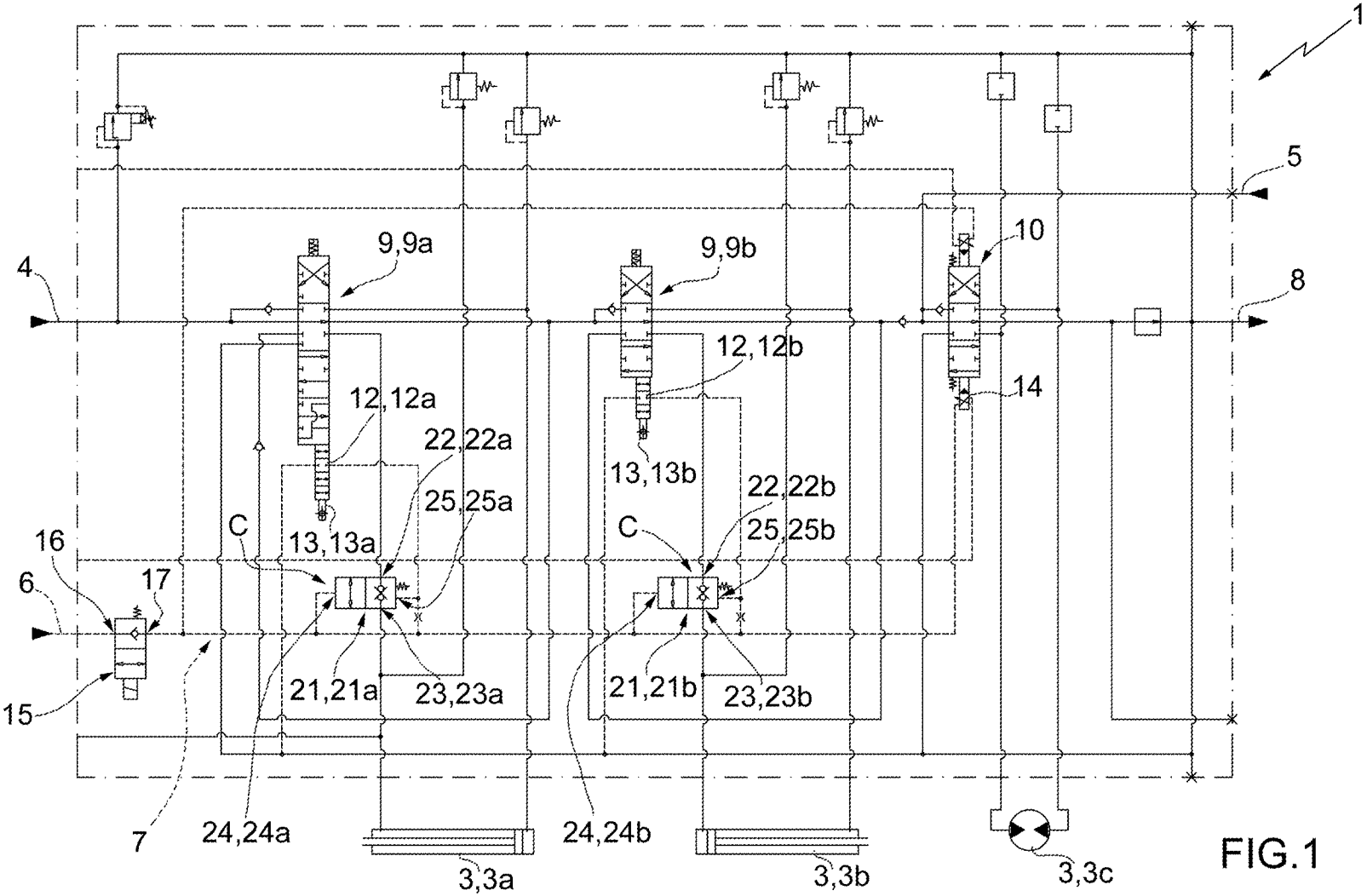
FIG. 1 is a schematic view, with parts removed for clarity, of a preferred embodiment of the hydraulic system according to the present invention in a first operating configuration.

In FIG. 1, number 1 indicates as a whole a hydraulic system for operating a plurality of hydraulic actuators 3 of an operating machine of a known type (not illustrated). For example, the operating machine is a mini-excavator and comprises a lift actuator 3*a*, a swivel actuator 3*b* and an auxiliary actuator 3*c*.

Figure 2:
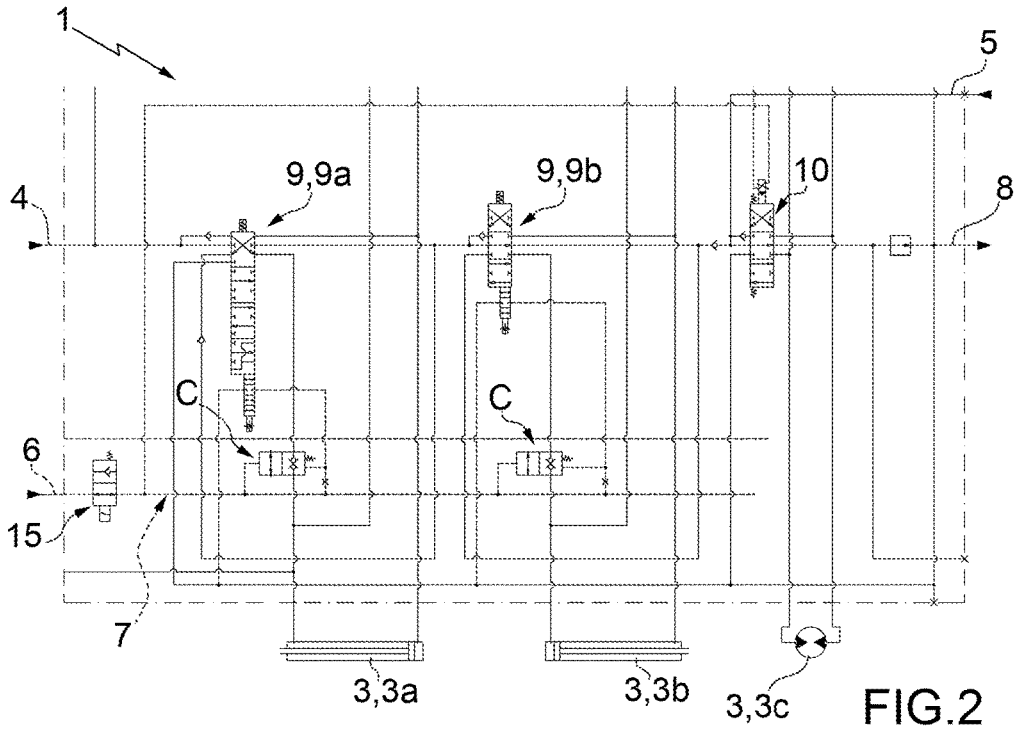
FIGS. 2 and 3 are similar, with parts removed for clarity, to FIG. 1 and illustrate the hydraulic system according to the present invention in a second and respectively, third operating configuration.
Figure 3:
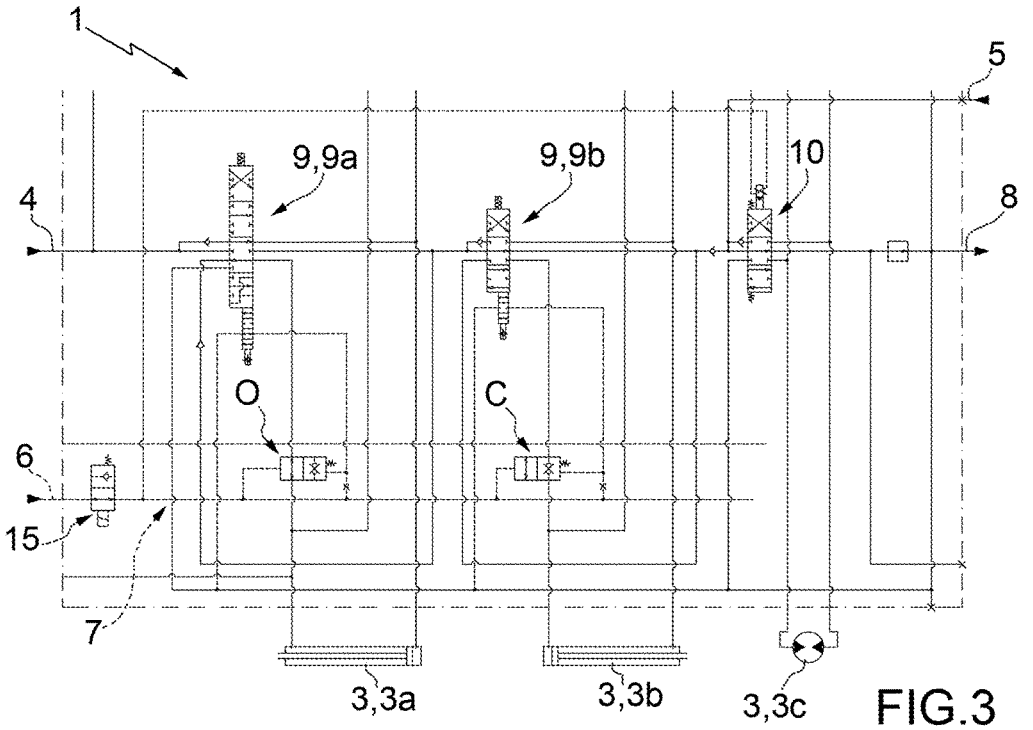
Figure 4:
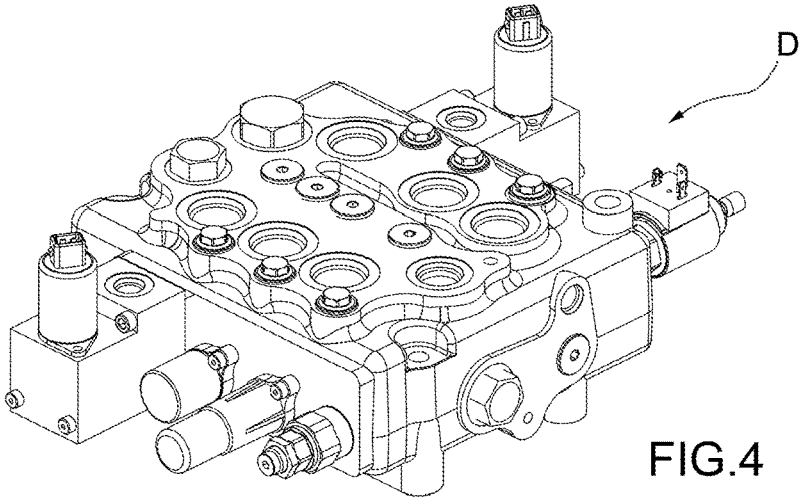
FIG. 4 is a perspective view of a hydraulic distributor for a hydraulic system according to the present invention.

The system 1 illustrated in FIGS. 1 to 3 is made, at least in part, within a distributor D. As illustrated in FIG. 1 and as will be shown more clearly below, the distributor D comprises the components of the system 1 enclosed within the rectangle dashed by two lines and a dot and marked with the letter D.

The hydraulic system 1 comprises:

- a high-pressure oil delivery 4, up to 350 bar, for the supplying of lift actuator 3*a*, the swivel actuator 3*b* and the auxiliary actuator 3*c;*
- a high-pressure oil delivery 5, up to 350 bar, for further supplying the auxiliary actuator 3*c;*
- a low-pressure oil delivery 6, between 20-30 bar, for the supplying of control circuit 7, as will be better explained later; and
- a drain line 8.

The distributor D has:

- an inlet I1 that can be connected in known manner to the high-pressure oil delivery 4;
- an inlet I2 that can be connected in a known manner to the high-pressure oil delivery 5;
- an entrance E that can be connected in a known manner to the low-pressure oil delivery;
- an outlet U1 that can be connected in known manner to a drain line 8; and
- an outlet U2 for the low-pressure oil.

The hydraulic system 1 comprises, furthermore, a slide valve 9*a* for controlling the lift actuator 3*a*; a slide valve 9*b* for controlling the swivel actuator 3*b* and a slide valve 10 for controlling the auxiliary actuator 3*c*.

The slide valve 9*a* comprises, in turn, a spool 12*a* and a control 13*a* connected to the spool 12*a* and that can be actuated directly by an operator. The spool 12*a* is mounted axially sliding within the slide valve 9*a*. Analogously, the slide valve 9*b* comprises, in turn, a spool 12*b* and a control 13*b* that is connected to the spool 12*b* and can be actuated directly by an operator. The spool 12*b* is mounted axially sliding within the slide valve 9*b*. The slide valve 10 comprises an actuator 14 (being in this case, but without limitation, a known type proportional electro-hydraulic actuator) connected to the delivery 6 of the control circuit 7.

In the following with the term bidirectional valve it is meant a hydraulically actuated valve, as will be explained, and suited to block the oil flow in both directions of passage through the valve itself. In other words, with the expression bidirectional valve it is meant a double seal valve or double check valve. In FIGS. 1 to 3 a bidirectional valve is graphically represented as a double cone seal valve. Preferably, the bidirectional valve is a bidirectional valve with two ways and with two positions.

As illustrated in FIGS. 1 to 3, the system 1 comprises: an activation control valve 15 of a known type, for example an electro-valve, having an inlet 16 connected to the low-pressure oil delivery 6 and an outlet 17 connected to the control circuit 7; a bidirectional valve 21*a*, which is interposed between the slide valve 9*a* and the actuator 3*a*; and a slide valve 21*b*, which is interposed between the slide valve 9*b* and the actuator 3*b*. Preferably, the activation valve 15 is a presence valve, which is suitable to be actuated when the operator is seated within the mini-excavator.

The outlet 17 can be connected to the drain 8 by means of one or more bidirectional valves 21 (21*a*; 21*b*) and the respective spools 12 (12*a*; 12*b*), as will be better explained later.

Since the bidirectional valves 21*a* and 21*b* are constructively identical, the following comments refer, for brevity, only to the bidirectional valve 21*a* but must be intended also as being valid for bidirectional valve 21*b*. In the figures, for the bidirectional valve 21*b*, the same numbering is kept for indicating the components of the bidirectional valve 21*a* with the subscript b.

The bidirectional valve 21*a* has:

- a passage opening 22*a* that can be connected, by means of the slide valve 9*a* to the delivery 4;
- a passage opening 23*a* connected to the lift actuator 3*a;*
- an inlet opening 24*a* that can be connected by means of the activation valve 15 to the low-pressure delivery 6; and
- an outlet opening 25*a* that can be connected to the drain 8 by means of the spool 12*a*.

The bidirectional valve 21*a* is a two-way valve and can selectively assume:

- a closing position C (illustrated in FIGS. 1 and 2) to interrupt the flow of high-pressure oil between the slide valve 9*a* and the actuator 3*a*; and
- an opening position O (illustrated in FIG. 3) to allow the passage for high-pressure oil between the slide valve 9 and the actuator 3*a*.

As illustrated in FIGS. 1 to 3, by way of example, the lift actuator 3*a* is a double acting hydraulic cylinder and the passage opening 23*a* is connected to the base of the actuator 3*a* (typically this type of connections is preferred for avoiding unintentional lowering of the loads). The swivel actuator 3*b* is a double acting hydraulic cylinder and the passage opening 23*b* is connected to the head of the actuator 3*b* (also this type of connection is preferred for preventing downward oscillations).

The actuator 3*c* is a bi-directional hydraulic motor. According to alternatives not illustrated, the actuators 3*a*, 3*b* and 3*c* are of a different type and are chosen, in a known manner, within a group of known hydraulic actuators and are different from each other (for example according to the function type).

Figure 5:
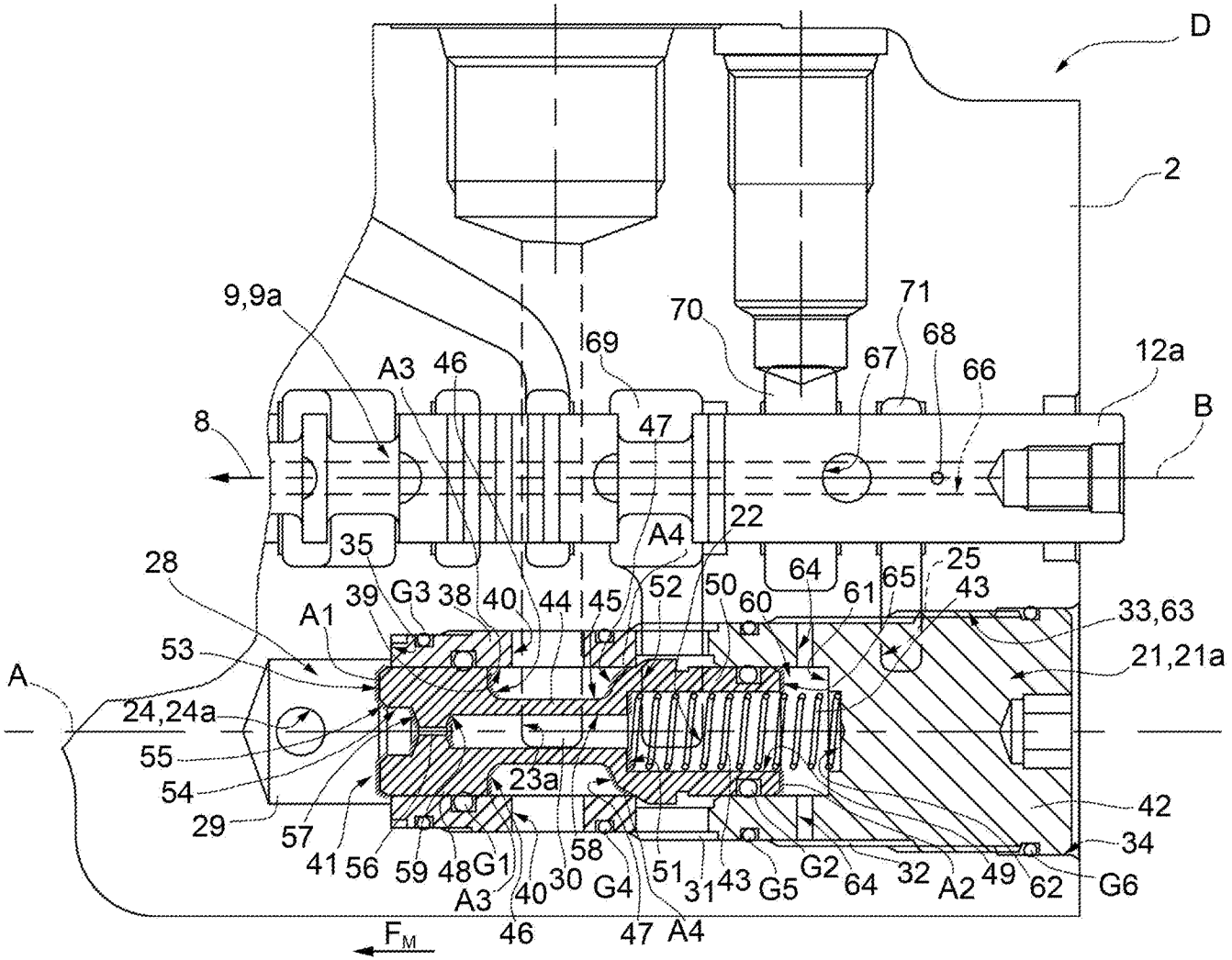
FIG. 5 illustrates in section and with parts removed for clarity, a detail of FIG. 4.

As illustrated in FIG. 5, the distributor D comprises a body 2 within which a part of the system 1 is made. In particular, the body 2 of the distributor D has a housing 28, substantially a hole, partially threaded and blind, within which a bidirectional valve 21*a* is made. The housing 28 is symmetrical with respect to a longitudinal axis A and has in sequence, longitudinally to the axis A and from the within towards the outside:

- a low-pressure oil inlet front chamber 29 having the inlet opening 24*a* which communicates with the low-pressure delivery 6;
- a high-pressure oil front passage chamber 30 having the passage opening 23*a* communicating with the actuator 3*a;*
- a high-pressure oil rear passage chamber 31 in connection with the groove of the slider 52 communicating with the spool 12*a;*
- a low-pressure oil outlet rear chamber 32 communicating with the spool 12*a*; and
- a threaded portion 33 that faces the outside of the body 2 of the distributor through an axial opening 34.

The housing 28 also has, furthermore, a shoulder surface 35, which is transverse to the axis A and separates the front inlet chamber 29 from the front passage chamber 30.

The body 2 has, moreover, a further housing (not illustrated) similar to the housing 28 which is suited to contain the bidirectional valve 21*b*.

As illustrated in FIG. 5, the bidirectional valve 21*a* comprises a partition member 38 having: a cylindrical body with a coaxial through longitudinal cavity 39 having circular section and a plurality of radial openings 40. The partition member 38 is inserted within the housing 28 in abutment against the shoulder surface 35 and is coaxial to the axis A of the housing 28. In particular, the partition member 38 extends longitudinally along the axis A between the shoulder surface 35 and the outlet opening 25*a*. The radial openings 40 are facing the passage opening 23*a*.

The bidirectional valve 21*a* also comprises:

- a shutter 41;
- a screw cap 42 which is partially threaded externally and is suited to be screwed into the housing 28 to close and calibrate the bidirectional valve 21*a*; and
- a cylindrical helical compression spring 43 which is interposed, along the axis A, between the shutter 41 and the cap 42, as will be explained better later.

As illustrated in FIG. 5, the shutter 41 comprises, in turn, a head 48 with a diameter substantially corresponding to the diameter of the cavity 39 of the partition member 38. In other words, the head 48 is coupled within the cavity 39 with a high precision sliding fit, which allows the sliding of head 48 within the cavity 39 and along the axis A.

The shutter 41 also comprises a cup-shaped body 50, which has a housing 49 defined longitudinally by a bottom 51 facing the screw cap 42 and is suited to house the spring 43, which is inserted, at least in part, within the cup body 50 and has a free end in contact with the bottom 51 of the housing 49. The spring 43 is coaxial to the axis A.

The shutter 41 comprises, furthermore, an abutment element 52 substantially frustoconical shaped which protrudes radially outwards from the cup-shaped body 50 and has an outer diameter greater than the diameter of the head 48. The abutment element 52 extends to the outside of the cup-shaped body 50, approximately at the bottom 51.

The abutment element 52 is suited to partially wedge itself within the partition member 38 and to stop in abutment against the partition member 38 itself, as illustrated in FIG. 5, when the bidirectional valve 21*a* is in the closing position C.

The shutter 41 comprises a cylinder of smaller diameter 44 which is interposed longitudinally between the head 48 and the cup-shaped body 50. The cylinder 44 defines an annular groove 45 external and coaxial to the body of the shutter 41. The annular groove 45 is interposed, along the axis A, between the head 48 and the cup-shaped body 50.

Figure 7:
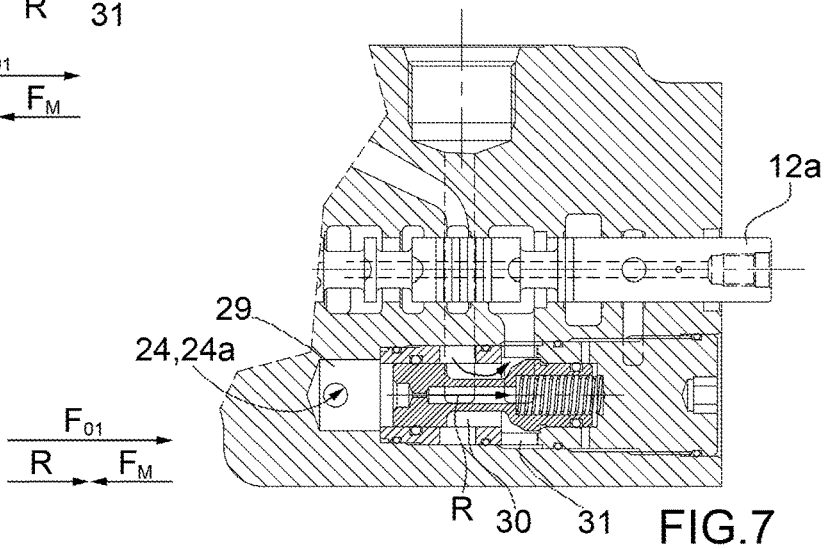
Figure 9:
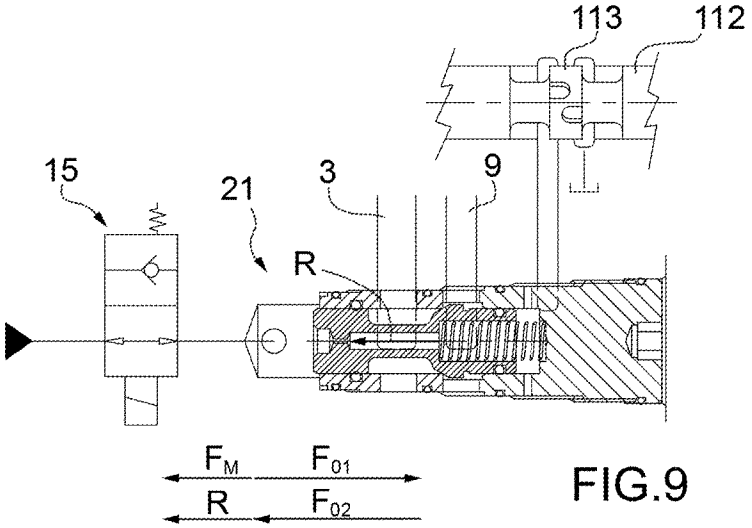
FIGS. 8 and 9 illustrate schematically and with parts removed for clarity, an alternative of the distributor to obtain the first and respectively, second operating configuration of the system illustrated in FIGS. 1 and 2.
Figure 8:
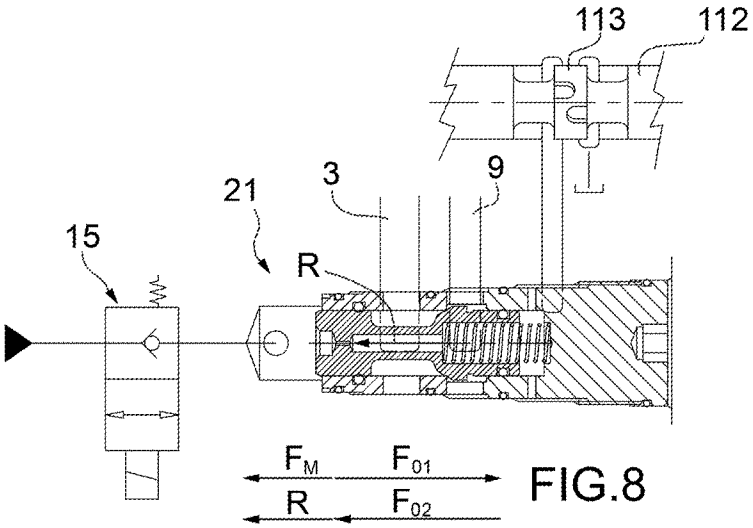

The longitudinal extension of the annular groove 45 is such as to place in communication the passage opening 23*a* with the outlet opening 25*a* when the shutter 41 is in the opening position O (FIGS. 6, 7, 10 and 11) and, analogously, such as to interrupt the communication between the passage opening 23*a* with the passage opening 22*a* when it is in the closing position C (FIGS. 5, 8 and 9). The annular groove is delimited longitudinally by a wall 46 and by a wall 47 which are opposite to one another.

The shutter 41 has:

a transverse surface 53, in particular perpendicular, to the axis A and facing the front chamber 29;

an axial hole 54 made in the head 48 and facing the feed chamber 29;

a narrowing hole 56; and a duct 58.

The hole 54, the narrowing hole 56 and the duct 58 have a circular cross section and are coaxial to the axis A. The duct 58 has an extension transversal to the axis A intermediate between the hole 54 and the narrowing hole 56. The duct 58 is facing the within of the housing 49 through the bottom 51.

In particular, the shutter 41 has a chamfer 55 interposed between the hole 54 and the surface 53;

a chamfer 57 interposed between the hole 54 and narrowing hole 56;

a chamfer 59 interposed between the narrowing hole 56 and the duct 58; and a transverse surface 65, in particular perpendicular to the axis A and facing towards the screw cap 42.

The junction of chamfer 55, hole 54, chamfer 57 narrowing hole 56, chamfer 59 and duct 58 place in fluid communication the chamber 29 with the housing 28.

The screw cap 42 has a housing 60 with a circular section and coaxial with axis A. The housing 60 is facing the shutter 41 and is suited to house, at least in part, the spring 43. The screw cap 42 has a bottom wall 61 transverse to the axis A and suited to delimit the housing 60 and has, furthermore: a circular shaped recess 62 and is coaxial with axis A made at the bottom wall 61; a radially outer threaded portion 63 which is suited to be coupled in a known manner with the threaded portion 33 of the housing 28. The screw cap 42 has, in addition, two or more radial holes 64, which radially place in communication the housing 60 with the outside. The radial holes 64 are substantially transverse to the axis A and are arranged in the proximity of the bottom wall 61. The holes 64 place in communication the housing 60 with the rear chamber 32, which is radially delimited within the body of the screw cap 42.

In FIG. 5 is illustrated, moreover, the slide valve 9*a*, which is a four-way and four positions valve of a known type and illustrated schematically. The slide valve 9*a*, as mentioned above is controlled by the spool 12*a*, which has: a tubular body with an axis B parallel to the axis A; a central cavity 66 in communication with the drain 8; a front radial opening 67; and a rear radial opening 68. The radial holes 67 and 68 place in communication the cavity 66 with the outside. The spool 12*a* is mounted mobile along the axis B in a known manner.

The body 2 of the distributor D also has an exchange chamber 69, which is in communication with the outlet opening 25*a* and a front drain channel 70 and a valve control channel 71, which is in communication with the rear chamber 32.

As illustrated in FIG. 5, the cup-shaped body 50 of the shutter 41 is inserted, at least in part, within the housing 60 of the screw cap with a male/female type coupling. The cup-shaped body 50 is coupled within the housing 60 with a high precision sliding fit, allowing the sliding, along the axis A, of the cup-shaped body 50 within the housing 60.

The spring 43 is mounted coaxial to the axis A, is interposed between the cup-shaped body 50 and the screw cap 42 and has one end in contact with the bottom 51 while the other end is inserted in the recess 62. The compression force $F_M$ of the spring 43 is calibrated, in a known manner, depending on the screwing degree of the screw cap 42 along the threaded portion 33 of the housing 28.

The bidirectional valve 21*a* also comprises:

an annular gasket G1 fit around the head 48 and interposed between the head 48 and the partition member 38, an annular gasket G2 fit around the cup-shaped body 50 and interposed between the cup-shaped body 50 and the screw cap 42;

two annular gaskets G3 and G4 fit around the partition member 38 and interposed between the partition member 38 and the body of the distributor D, the radial openings 40 are interposed, along the axis A, between the gaskets G3 and G4;

two annular gaskets G5 and G6 fit around the screw cap 42 and interposed between the screw cap 42 and the body 2 of the distributor D, the radial holes 64 are interposed, along the axis A, between the gaskets G5 and G6.

The gaskets G1-G6 mentioned above are of a known type and are suited to prevent the leakage of the oil within the bidirectional valve 21*a*.

It is observed that the shutter 41 has a thrust area A1 exposed to the oil pressure in the front chamber 29 and in the hole 54, and a thrust area A2 exposed to the oil pressure in the duct 58, in the housing 49 and in the housing 60.

Furthermore, the shutter 41 has a thrust area A3 and a thrust area A4 both exposed to the oil pressure in the front passage chamber 30.

The thrust area A1 comprises: the surface 53, the chamfer 55 and the chamfer 57. The thrust area A2 comprises: the chamfer 59, the bottom 51 and the surface 65. The thrust area A3 comprises the wall 46 and the thrust area A4 comprises the wall 47. The thrust area A1 is equal to the thrust area A2. The thrust area A3 is equal to the thrust area A4. The equality of the thrust areas A1 and A2 and the equality of the thrust areas A3 and A4 allow to balance the thrusts on the shutter 41 along the axis A ensuring positioning the shutter 41 in the closing position C (illustrated in FIGS. 5, 8 and 9) when the spool 12*a* is in the stand-by position, i.e. when the actuator 3*a* must remain in a static position.

This is particularly advantageous in that the shutter 41 prevents any kind of leakage of the high-pressure oil coming from the delivery 4, or from the actuator 3*a* itself, ensuring the constant positioning of the actuator 3*a*. In other words, the bidirectional valve 21*a* provided with the shutter prevents the actuator 3*a* from being unintentionally activated because of the leakage of high-pressure oil or of applied external loads. It is ensured in this way maximum safety to the operator and to the working area surrounding the mini-excavator and movements of the cylinders due to leakage during certain working conditions.

FIGS. 8 to 11 illustrate an alternative of the distributor D comprising a solid stem 112 (with no inner cavity) and an annular deflecting element 113, which protrudes radially from the stem 112 and is suited to direct the oil flow (in a known manner and illustrated in a schematic way) between the slider of the slide valve 9*a*.

In use, the hydraulic system 1 for actuating the mini-excavator is supplied by means of the delivery 4 with high-pressure oil, up to a maximum of 350 bar; while, the delivery 6 supplies the controlling circuit 7 with low-pressure oil, at approximately 20-30 bars.

It should be noted that since the thrust areas A3 and A4 are equal and opposite to one another and that the annular groove 45 is exposed in all operating configurations to the high-pressure oil coming from the delivery 4, the resultant of the thrust forces along the axis A on the shutter 41 due to the action of the high-pressure oil is zero in any operative configuration.

In FIG. 1 the stand-by configuration is illustrated wherein: the activation valve 15 is in the closing position preventing flow within the control circuit 7; and the spools 12*a* and 12*b* are in the central position thus interrupting both the high-pressure oil flow and the connection of the bidirectional valves 21*a* and, respectively, 21*b* with the drain 8.

When the hydraulic system 1 is in the stand-by configuration, the bidirectional valves 21 are arranged as illustrated in FIGS. 5 and 8. In other words, the shutter 41 along the axis A is subject solely to the compression force $F_M$ exerted by the spring 43, which keeps the shutter 41 in the closing position C with the abutment element 52 pressed against the partition member 38, so as to interrupt the high-pressure oil flow between the passage opening 23 and the passage opening 22.

In FIG. 2 a waiting stand-by configuration is illustrated wherein: the activation valve 15 is activated and the low-pressure oil enters the control circuit 7, and the spools 12 are in the central position.

In standby configuration, the operator is present and seated on the mini-excavator but is not yet operating the actuators 3 by way of the spools 12. When the system is in the standby configuration, the bidirectional valves 21 are arranged in the closing position as illustrated in FIG. 9 and the low-pressure oil within the housing 28 acts upon: the thrust area A1 with a thrust force $F_{O1}$; and the thrust area A2 with a thrust force $F_{O2}$.

Since the thrust areas A1 and A2 are equal and opposite to one another, the resultant R of the thrust forces $F_{O1}$ and $F_{O2}$ along the axis A on the shutter 41 is zero. In other words, in the standby configuration, the action of low-pressure oil within the bidirectional valves 21 does not push the shutter 41 along the axis A.

Therefore, the shutter 41 is kept in the closing position C by the compression force $F_M$ of the spring 43, analogously to what happens in the stand-by configuration, as the resultant R of the forces to which the shutter 41 is subjected along the axis A corresponds to the compression force $F_M$ exerted by the spring 43 to keep the shutter 41 in the closing position C with the abutment element 52 pressed against the partition member 38 so as to interrupt the high-pressure oil flow between the passage opening 23 and the passage opening 22.

In FIG. 3 a working configuration is illustrated wherein: the activation valve 15 is activated and the low-pressure oil enters the control circuit 7; and the spool 12*a* is in the working position (while the spool 12*b* is in the center position).

Obviously what follows also applies when both the spools 12 are in the working position; or, when the spool 12*b* is in the working position while the spool 12*a* is in the central position.

When the system is in the working configuration, the bidirectional valves 21 are arranged as illustrated in FIGS. 6, 7 and 10, 11. In particular, the spool 12 (or 112) is axially displaced in order to place in communication the rear chamber 32 with the drain 8. In this way, the rear chamber 32 and the housings 49 and 60 are emptied very quickly, almost instantaneously, while the narrowing 56 reduces the flow rate of the low-pressure oil from the front chamber 29 to the rear chamber 32 producing a variation in quantity and oil pressure between the front chamber 29 and rear chamber 32. Since the rear chamber 32 is permanently connected to the drain 8, by means of the narrowing 56 it is obtained that the front chamber 29 is filled with low-pressure oil while the rear chamber 32 is substantially empty and at ambient pressure. In this condition, the low-pressure oil in the front chamber 29 exerts on the thrust area A1 a thrust force $F_{O1}$ greater than the compression force $F_M$ of the spring 43 and of the force $F_{O2}$ (almost zero of the oil on the thrust area A2).

Figure 6:
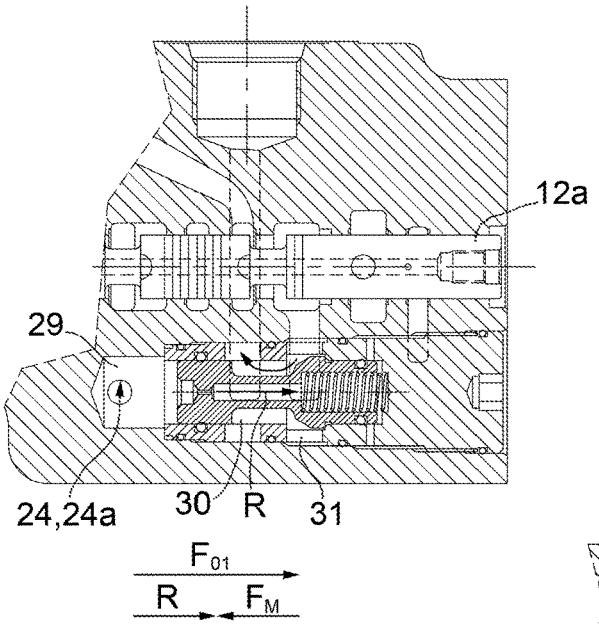
FIGS. 6 and 7 are similar to FIG. 5, with parts removed for clarity, and illustrate the distributor in two respective different operating configurations.
Figure 11:
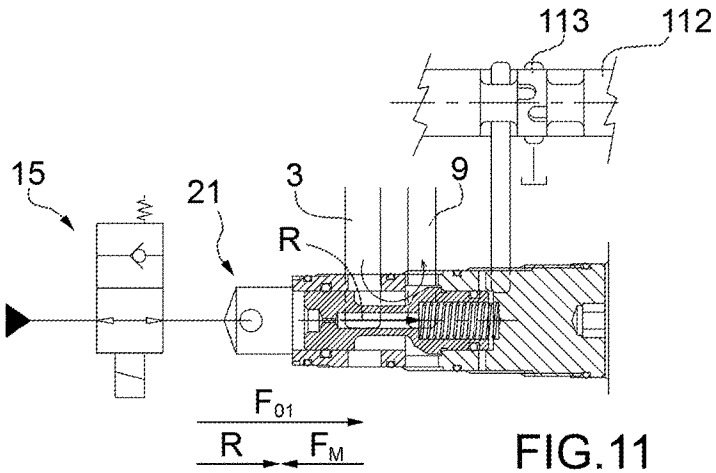
FIGS. 10 and 11 illustrate schematically and with parts removed for clarity, an alternative of the distributor according to the present invention in two respective different operating configurations.
Figure 10:
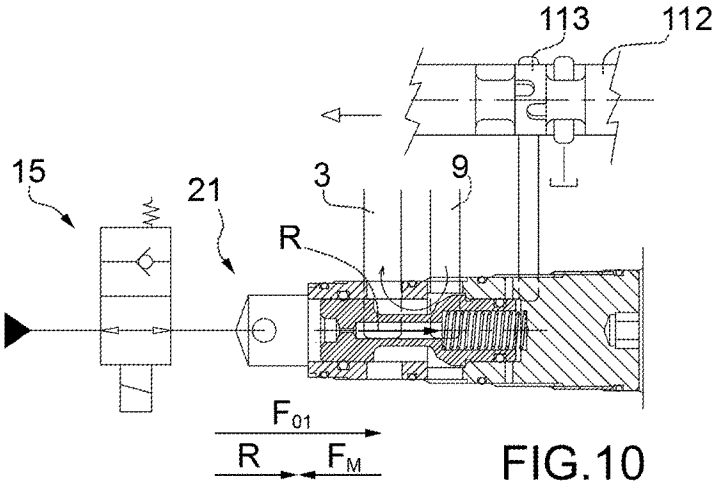

Therefore, the resultant R of the forces acting on the shutter 41 along the axis A causes the sliding of the shutter 41 itself in the same direction of the oil flow thus compressing the spring 43 towards the opening position O, wherein the passage opening 23 is in communication with the passage opening 22. FIGS. 6 and 10 illustrate a bidirectional valve during the crossing of high-pressure oil from the slide valve 9 to the actuator 3. In the case wherein the actuator 3 is the lift cylinder 3*a*, the mini-excavator is performing a lifting operation. Similarly illustrated in FIGS. 7 and 11 is a bidirectional valve 21 during the crossing of high-pressure oil from the actuator 3 to the slide valve 9. In the case wherein the actuator 3 is the lift cylinder 3*a*, the mini-excavator is performing a lowering operation.

From the above it results that each bidirectional valve 21 ensures the perfect sealing of the high-pressure oil in any condition of use. In particular, the bidirectional valves 21 are particularly efficient to ensuring the sealing of the bottom of the lift cylinder 3*a* and the head of the swivel cylinder 3*b*.

Furthermore, the bidirectional valves 21 ensure additional safety to the system 1 and to the distributor 2; in that, in order to operate the respective actuator 3 it is necessary to activate both the activation valve 15, which guarantees the presence of the operator, and the displacement of the spool 12 from the central position, which ensures the desired activation action of the actuator 3 by the operator. In other words, in order to activate the oil flow between a slide valve 9 and the respective actuator 3 a double control action is provided.

This of course is of great advantage compared to standard type systems and distributors wherein the activation valve 15 to detect the presence of the operator is the only safety measure.

Moreover, the presence of a bidirectional valve 21 for each actuator 3 allows to render the actuators 3 totally independent of one another upon leakage.

In that, the seal of each actuator 3 is guaranteed until the actuation of the respective spool 12 independently from the other actuator.

Finally, each bidirectional valve of the type described above prevents the leakage of the high-pressure oil due to a rise of pressure within the high-pressure circuit, generally due to a continuous actuation (typically the actuation of the auxiliary one). In this way the perfect seal of each actuator 3 even in the presence of a continuous actuation of the system 1 is guaranteed.

The invention claimed is:

1. A hydraulic system to activate the hydraulic actuators (3; 3*a*, 3*b*) of an operating machine; the hydraulic system (1) comprises:

a first high-pressure oil delivery (4);

an oil drain (8);

a first slide valve (9; 9*a*), which comprises a first spool (12; 12*a*) axially sliding and suited to control a first hydraulic actuator (3; 3*a*);

a second low-pressure oil delivery (6);

an activation valve (15); and a first bidirectional valve (21; 21*a*) having a first passage opening (22; 22*a*) that can be hydraulically connected, by means of the first slide valve (9; 9*a*) to the first delivery (4) and a second passage opening (23; 23*a*) hydraulically connected to the first actuator (3; 3*a*); wherein the first bidirectional valve (21; 21*a*) has an inlet opening (24; 24*a*) that can be connected, by means of the activation valve (15), to the second delivery (6) and an outlet opening (25; 25*a*) that can be connected, by means of the first spool (12; 12*a*) to the drain (8).

2. A hydraulic system according to claim 1 and comprising a second slide valve (21; 21*b*), which comprises, in turn, a second spool (12; 12*b*) axially sliding and suited to control a second hydraulic actuator (3; 3*b*);

the hydraulic system (1) further comprising a second bidirectional valve (21; 21*b*) having a first passage opening (22; 22*b*) that can be hydraulically connected, by means of the second slide valve (21; 21*b*), to the first delivery (4), and a second passage opening (23; 23*b*) hydraulically connected to the second actuator (3; 3*b*); wherein the second bidirectional valve (21; 21*b*) has an inlet opening (24; 24*b*) that can be connected, by means of the activation valve (15), to the second delivery (6) and an outlet opening (25; 25*b*) that can be connected, by means of the second spool (12; 12*b*), to the drain (8).

3. A hydraulic system according to claim 1, wherein each bidirectional valve (21) comprises a shutter (41) which can be selectively arranged: in a closing position (C) to interrupt the oil flow between the respective actuator (3) and the respective slide valve (9); and in an opening position (0) to allow oil to flow between the respective slide valve (9) and the respective actuator (3); wherein each bidirectional valve (21) is hydraulically activated both by means of the activation valve (15) and by means of the respective spool (12).

4. A hydraulic system according to claim 3, wherein each bidirectional valve (21) connects the respective actuator (3) to the respective slide valve (9) when: the activation valve (15) connects the inlet opening (24) to the second oil delivery (6); and the respective spool (12) connects the outlet opening (25) to the drain (8); wherein the shutter (41) has a first and a second thrust areas (A1, A2), which are substantially transverse to the longitudinal axis (A) and are opposite to one another; wherein the shutter (41) has a longitudinal inner through cavity (66) suited to establish a fluid communication between the inlet opening (24) and the outlet opening (25); the shutter (41) has, furthermore a third and a fourth thrust areas (A3, A4) which are substantially transverse to the longitudinal axis (A) and are opposite to one another; the first and the second thrust areas (A1; A2) are subject to the pressure of the oil of the second delivery (6); the third and the fourth thrust areas (A3; A4) are subject to the pressure of the oil of the first delivery (4); the first and the second thrust areas (A1, A2) being equal to one another; the third and fourth thrust areas (A3, A4) being equal to one another.

5. A distributor for a hydraulic system (1), as claimed in claim 1 and comprising a first slide valve (9; 9*a*), which comprises, in turn, a first spool (12; 12*a*) axially sliding and suited to control a first hydraulic actuator (3;3*a*); the distributor further comprising a first bidirectional valve (21; 21*a*) having a first passage opening (22; 22*a*) that can be hydraulically connected, by means of the first slide valve (9; 9*a*), to the first delivery (4) and a second passage opening (23; 23*a*) hydraulically connected to the first hydraulic actuator (3; 3*a*); wherein the first bidirectional valve (21; 21*a*) has an inlet opening (24; 24*a*) that can be connected, by means of the activation valve (15), to the second delivery (6) and an outlet opening (25; 25*a*) that can be connected, by means of the first spool (12; 12*a*), to the drain (8).

6. A distributor according to claim 5 and comprising a second slide valve (21; 21*b*), which comprises, in turn, a second spool (12; 12*b*) axially sliding and suited to control a second hydraulic actuator (3; 3*b*); the distributor further comprising a second bidirectional valve (21; 21*b*) hydraulically connected to the second slide valve (21; 21*b*); wherein the second bidirectional valve (21; 21*b*) has a first passage opening (22; 22*b*) that can be hydraulically connected, by means of the second slide valve (21; 21*b*), to the first delivery (4) and a second passage opening (23; 23*b*) hydraulically connected to the second hydraulic actuator (3; 3*b*); wherein the second bidirectional valve (21; 21*b*) has an inlet opening (24; 24*b*) that can be connected, by means of the activation valve (15), to the second delivery (6) and an outlet opening (25; 25*b*) that can be connected, by means of the second spool (12; 12*b*) to the drain (8).

7. A distributor for a hydraulic system (1), as claimed in claim 1 and having a first inlet (II) of high-pressure oil, an entrance (E) for low-pressure oil and an outlet (U1) for high-pressure oil; the distributor comprising a first slide valve (9; 9*a*), which comprises, in turn, a first spool (12; 12*a*) axially sliding suited to control a first hydraulic actuator (3; 3*a*); the distributor comprising an activation valve (15) suited to adjust, in use, the passage of low-pressure oil through said entrance (E); the distributor further comprising a first bidirectional valve (21; 21*a*) having a first passage opening (22; 22*a*) that can be hydraulically connected, by means of the first slide valve (9; 9*a*) to said first inlet (II) and a second passage opening (23; 23*a*) hydraulically connected to the first hydraulic actuator (3; 3*a*); wherein the first bidirectional valve (21; 21*a*) has an inlet opening (24; 24*a*) that can be connected, by means of the activation valve (15), to said entrance (E) for low-pressure oil and an outlet opening (25; 25*a*) that can be connected by means of the first spool (12; 12*a*) to said outlet (U1).

8. A distributor according to claim 7 and comprising a second slide valve (21; 21*b*), which comprises, in turn, a second spool (12; 12*b*) sliding axially and suited to control a second hydraulic actuator (3; 3*b*); the distributor further comprising a second bidirectional valve (21; 21*b*) hydraulically connected to the second slide valve (21; 21*b*); wherein the second bidirectional valve (21; 21*b*) has a first passage opening (22; 22*b*) that can be hydraulically connected, by means of the second slide valve (21; 21*b*), to said first inlet (II) for high-pressure oil and a second passage opening (23; 23*b*) hydraulically connected to the second hydraulic actuator (3; 3*b*); wherein the second bidirectional valve (21; 21*b*) has an inlet opening (24; 24*b*) that can be connected, by means of the activation valve (15) to said entrance (E) for low-pressure oil and an outlet opening (25; 25*b*) that can be connected, by means of the second spool (12; 12*b*) to said outlet (U1).

9. A distributor according to claim 5, wherein each spool (12) has an inner cavity (66), which is connected to a drain (8), in particular said outlet (U1) for high-pressure oil, and a radial opening (68) which connects the inner cavity (66) to the outside; wherein the outlet opening (25) of each bidirectional valve (21) can be connected to the drain (8) through said radial opening (68).

10. A bidirectional valve for a hydraulic system (1), as claimed in claim 1 and having:

a first passage opening (22) that can be hydraulically connected, to a first oil delivery (4);

a second passage opening (23) that can be hydraulically connected, to a hydraulic actuator (3);

an inlet opening (24) that can be hydraulically connected, to a second oil delivery (6); and an outlet opening (25) that can be connected to a drain (8).

11. A bidirectional valve according to claim 10 and having:

a first passage chamber (31) which faces the first passage opening (22);

a second passage chamber (30) which faces the second passage opening (23);

an inlet chamber (29) which faces the inlet opening (24); and an outlet chamber (32) which faces the outlet opening (25); and wherein the bidirectional valve (21) comprises a shutter (41), which is mounted so as to be alternatively mobile along a longitudinal axis (A) from a closing position (C), in which the oil flow of the first delivery (4) between the first and the second passage openings (22; 23) is interrupted, to an opening position (0), in which the oil flow of the first delivery (4) between the first and the second passage openings (22; 23) is permitted; wherein the shutter (41) has a longitudinal inner through cavity (66) suited to establish a fluid communication between the inlet opening (24) and the outlet opening (25); and wherein the shutter (41) has a first and a second thrust areas (A1, A2), which are substantially transverse to the longitudinal axis (A) and are opposite to one another; the shutter (41) has, furthermore, a third and a fourth thrust areas (A3, A4) which are substantially transverse to the longitudinal axis (A) and are opposite to one another; the first and the second thrust areas (A1; A2) are subject to the pressure of the oil of the second delivery (6); the third and fourth thrust areas (A3; A4) are subject to the pressure of the oil of the first delivery (4); the first and the second thrust areas (A1, A2) being equal to one another; the third and fourth thrust areas (A3, A4) being equal to one another.

12. A bidirectional valve according to claim 11 wherein the first thrust area (A1) faces the inlet chamber (29) and the second thrust area (A2) faces the outlet chamber (32); wherein the shutter (41) has a narrowing (56) of the inner cavity (66) which limits the flow rate of the oil flowing through the shutter (41) between the inlet chamber (29) and the outlet chamber (32); and wherein the bidirectional valve (21) comprises a spring (43) suited to keep the shutter (41) unmoving in the closing position (C); the spring (43) being suited to push the shutter (41) in the opposite direction relative to the direction with which the oil of the second delivery (6) flows through said shutter (41).

13. A hydraulic system according to claim 2, wherein each bidirectional valve (21) comprises a shutter (41) which can be selectively arranged: in a closing position (C) to interrupt the oil flow between the respective actuator (3) and the respective slide valve (9); and in an opening position (0) to allow oil to flow between the respective slide valve (9) and the respective actuator (3); wherein each bidirectional valve (21) is hydraulically activated both by means of the activation valve (15) and by means of the respective spool (12).

14. A distributor for a hydraulic system (1), as claimed in claim 2 and comprising a first slide valve (9; 9*a*), which comprises, in turn, a first spool (12; 12*a*) axially sliding and suited to control a first hydraulic actuator (3; 3*a*); the distributor further comprising a first bidirectional valve (21; 21*a*) having a first passage opening (22; 22*a*) that can be hydraulically connected, by means of the first slide valve (9; 9*a*), to the first delivery (4) and a second passage opening (23; 23*a*) hydraulically connected to the first hydraulic actuator (3; 3*a*); wherein the first bidirectional valve (21; 21*a*) has an inlet opening (24; 24*a*) that can be connected, by means of the activation valve (15), to the second delivery (6) and an outlet opening (25; 25*a*) that can be connected, by means of the first spool (12; 12*a*), to the drain (8).

15. A distributor for a hydraulic system (1), as claimed in claim 3 and comprising a first slide valve (9; 9*a*), which comprises, in turn, a first spool (12; 12*a*) axially sliding and suited to control a first hydraulic actuator (3; 3*a*); the distributor further comprising a first bidirectional valve (21; 21*a*) having a first passage opening (22; 22*a*) that can be hydraulically connected, by means of the first slide valve (9; 9*a*), to the first delivery (4) and a second passage opening (23; 23*a*) hydraulically connected to the first hydraulic actuator (3; 3*a*); wherein the first bidirectional valve (21; 21*a*) has an inlet opening (24; 24*a*) that can be connected, by means of the activation valve (15), to the second delivery (6) and an outlet opening (25; 25*a*) that can be connected, by means of the first spool (12; 12*a*), to the drain (8).

16. A distributor for a hydraulic system (1), as claimed in claim 4 and comprising a first slide valve (9; 9*a*), which comprises, in turn, a first spool (12; 12*a*) axially sliding and suited to control a first hydraulic actuator (3; 3*a*); the distributor further comprising a first bidirectional valve (21; 21*a*) having a first passage opening (22; 22*a*) that can be hydraulically connected, by means of the first slide valve (9; 9*a*), to the first delivery (4) and a second passage opening (23; 23*a*) hydraulically connected to the first hydraulic actuator (3; 3*a*); wherein the first bidirectional valve (21; 21*a*) has an inlet opening (24; 24*a*) that can be connected, by means of the activation valve (15), to the second delivery (6) and an outlet opening (25; 25*a*) that can be connected, by means of the first spool (12; 12*a*), to the drain (8).

17. A distributor for a hydraulic system (1), as claimed in claim 2 and having a first inlet (II) of high-pressure oil, an entrance (E) for low-pressure oil and an outlet (U1) for high-pressure oil; the distributor comprising a first slide valve (9; 9*a*), which comprises, in turn, a first spool (12; 12*a*) axially sliding suited to control a first hydraulic actuator (3; 3*a*); the distributor comprising an activation valve (15) suited to adjust, in use, the passage of low-pressure oil through said entrance (E); the distributor further comprising a first bidirectional valve (21; 21*a*) having a first passage opening (22; 22*a*) that can be hydraulically connected, by means of the first slide valve (9; 9*a*) to said first inlet (II) and a second passage opening (23; 23*a*) hydraulically connected to the first hydraulic actuator (3; 3*a*); wherein the first bidirectional valve (21; 21*a*) has an inlet opening (24; 24*a*) that can be connected, by means of the activation valve (15), to said entrance (E) for low-pressure oil and an outlet opening (25; 25*a*) that can be connected by means of the first spool (12; 12*a*) to said outlet (U1).

18. A distributor for a hydraulic system (1), as claimed in claim 3 and having a first inlet (II) of high-pressure oil, an entrance (E) for low-pressure oil and an outlet (U1) for high-pressure oil; the distributor comprising a first slide valve (9; 9*a*), which comprises, in turn, a first spool (12; 12*a*) axially sliding suited to control a first hydraulic actuator (3; 3*a*); the distributor comprising an activation valve (15) suited to adjust, in use, the passage of low-pressure oil through said entrance (E); the distributor further comprising a first bidirectional valve (21; 21*a*) having a first passage opening (22; 22*a*) that can be hydraulically connected, by means of the first slide valve (9; 9*a*) to said first inlet (II) and a second passage opening (23; 23*a*) hydraulically connected to the first hydraulic actuator (3; 3*a*); wherein the first bidirectional valve (21; 21*a*) has an inlet opening (24; 24*a*) that can be connected, by means of the activation valve (15), to said entrance (E) for low-pressure oil and an outlet opening (25; 25*a*) that can be connected by means of the first spool (12; 12*a*) to said outlet (U1).

19. A distributor for a hydraulic system (1), as claimed in claim 4 and having a first inlet (II) of high-pressure oil, an entrance (E) for low-pressure oil and an outlet (U1) for high-pressure oil; the distributor comprising a first slide valve (9; 9*a*), which comprises, in turn, a first spool (12; 12*a*) axially sliding suited to control a first hydraulic actuator (3; 3*a*); the distributor comprising an activation valve (15) suited to adjust, in use, the passage of low-pressure oil through said entrance (E); the distributor further comprising a first bidirectional valve (21; 21*a*) having a first passage opening (22; 22*a*) that can be hydraulically connected, by means of the first slide valve (9; 9*a*) to said first inlet (II) and a second passage opening (23; 23*a*) hydraulically connected to the first hydraulic actuator (3; 3*a*); wherein the first bidirectional valve (21; 21*a*) has an inlet opening (24; 24*a*) that can be connected, by means of the activation valve (15), to said entrance (E) for low-pressure oil and an outlet opening (25; 25*a*) that can be connected by means of the first spool (12; 12*a*) to said outlet (U1).

20. A distributor according to claim 6, wherein each spool (12) has an inner cavity (66), which is connected to a drain (8), in particular said outlet (U1) for high-pressure oil, and a radial opening (68) which connects the inner cavity (66) to the outside; wherein the outlet opening (25) of each bidirectional valve (21) can be connected to the drain (8) through said radial opening (68).

* * * * *